US007696950B2

(12) United States Patent
Tsai et al.

(10) Patent No.: US 7,696,950 B2
(45) Date of Patent: Apr. 13, 2010

(54) ANTENNA WITH SYMMETRICAL FIRST AND SECOND MONOPOLE RADIATING ELEMENTS

(75) Inventors: Tiao-Hsing Tsai, Tao Yuan Shien (TW); Chao-Hsu Wu, Tao Yuan Shien (TW); Chieh-Ping Chiu, Tao Yuan Shien (TW)

(73) Assignee: Quanta Computer, Inc., Tao Yuan Shien (TW)

( * ) Notice: Subject to any disclaimer, the term of this patent is extended or adjusted under 35 U.S.C. 154(b) by 0 days.

(21) Appl. No.: 12/152,696

(22) Filed: May 15, 2008

(65) Prior Publication Data

US 2009/0135069 A1 May 28, 2009

(30) Foreign Application Priority Data

Nov. 22, 2007 (TW) ..... 96144237 A

(51) Int. Cl.
*H01Q 1/24* (2006.01)
*H01Q 21/00* (2006.01)

(52) U.S. Cl. ..... 343/893; 343/702; 343/806

(58) Field of Classification Search ..... 343/700 MS, 343/702, 806, 795, 803, 850, 853, 893, 895
See application file for complete search history.

(56) References Cited

U.S. PATENT DOCUMENTS 4,381,566 A * 4/1983 Kane ..... 455/193.3
5,936,587 A * 8/1999 Gudilev et al. ..... 343/752

* cited by examiner

*Primary Examiner*—Michael C Wimer
(74) *Attorney, Agent, or Firm*—David N. Lathrop

(57) ABSTRACT

An antenna, which is operable in a digital video broadcasting for handhelds (DVB-H) frequency range, includes first and second monopole radiating elements and a feeding element. The first and second monopole radiating elements are symmetrical about an axis of symmetry and have a meandering shape. The feeding element interconnects the first and second monopole radiating elements.

10 Claims, 7 Drawing Sheets

ANTENNA WITH SYMMETRICAL FIRST AND SECOND MONOPOLE RADIATING ELEMENTS

CROSS-REFERENCE TO RELATED APPLICATION

This application claims priority of Taiwanese application no. 096144237, filed on Nov. 22, 2007.

BACKGROUND OF THE INVENTION

1. Field of the Invention

This invention relates to an antenna, more particularly to an antenna operable in a digital video broadcasting-handheld (DVB-H) frequency range.

2. Description of the Related Art

In U.S. Patent Application Publication No. US20060214857, there is disclosed an antenna that conforms to a digital video broadcasting for handhelds (DVB-H) specification. The conventional antenna includes a radiating element, a feeding line, a matching circuit, and a radio frequency (RF) circuit. The radiating element is L-shaped. The feeding line is coupled to the radiating element and is formed on a dielectric substrate. The matching circuit is coupled to the feeding line and is formed on the dielectric substrate. The RF circuit is coupled to the matching circuit and is formed on the dielectric substrate.

The conventional antenna is disadvantageous in that the conventional antenna has a relatively low gain. Furthermore, adjustment of a coupling distance between the matching circuit and the RF circuit so as to permit operation of the conventional antenna at a desired frequency is difficult to perform.

SUMMARY OF THE INVENTION

Therefore, the object of the present invention is to provide an antenna that can overcome the aforesaid drawbacks of the prior art.

According to the present invention, an antenna comprises first and second monopole radiating elements and a feeding element. The first and second monopole radiating elements are symmetrical about an axis of symmetry. Each of the first and second monopole radiating elements has a meandering shape, and opposite first and second ends. The feeding element interconnects the first ends of the first and second monopole radiating elements.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
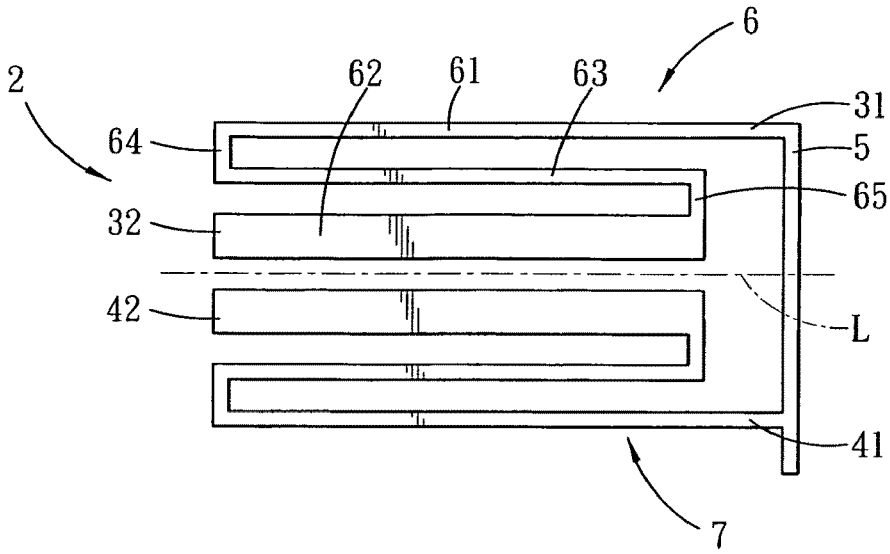
FIG. 1 is a schematic view of the first preferred embodiment of an antenna according to this invention.

Before the present invention is described in greater detail, it should be noted that like elements are denoted by the same reference numerals throughout the disclosure.

Referring to FIG. 1, the first preferred embodiment of an antenna 2 according to this invention is shown to include first and second monopole radiating elements 6, 7, and a feeding element 5.

The antenna 2 of this invention may be installed in a handheld electronic device (not shown), such as a personal digital assistant (PDA) or a mobile phone, and is operable in a digital video broadcasting for handhelds (DVB-H) frequency range from 470 MHz to 862 MHz.

The first and second monopole radiating elements 6, 7 are symmetrical about an axis of symmetry (L). In this embodiment, each of the first and second monopole radiating elements 6, 7 has a meandering shape, opposite first and second ends 31, 41, 32, 42, and an intermediate portion that interconnects the first and second ends 31, 41, 32, 42 thereof.

In this embodiment, the second ends 32, 42 of the first and second monopole radiating elements 6, 7 define a distance therebetween smaller than that between the first ends 31, 41 of the first and second monopole radiating elements 6, 7.

Since the first and second monopole radiating elements 6, 7 are symmetrical about the axis of symmetry (L), and therefore have the same structure, only the intermediate portion of the first monopole radiating element 6 will be described herein.

The intermediate portion is generally S-shaped. In particular, the intermediate portion includes first and second segments 61, 62 that are parallel to the axis of symmetry (L) and that are respectively disposed distal from and proximate to the axis of symmetry (L), a third segment 63 that is parallel to the axis of symmetry (L) and that is disposed between the first and second segments 61, 62, a fourth segment 64 that is transverse to the axis of symmetry (L) and that interconnects the first and third segments 61, 63, and a fifth segment 65 that is transverse to the axis of symmetry (L) and that interconnects the second and third segments 62, 63. In this embodiment, the second and third segments 62, 63 have the same length. Moreover, in this embodiment, the fourth and fifth segments 64, 65 have the same length. Further, in this embodiment, the second segment 62 has a width that is wider than that of the first, third, fourth, and fifth segments 61, 63, 64, 65. In addition, in this embodiment, the second segment 62 and the axis of symmetry (L) define a distance therebetween that is less than 1.5 millimeters. The construction as such increases a gain of the antenna 2 of this invention.

The feeding element 5 interconnects the first ends 31, 41 of the first and second monopole radiating elements 6, 7, and extends transversely to the axis of symmetry (L).

Figure 2:
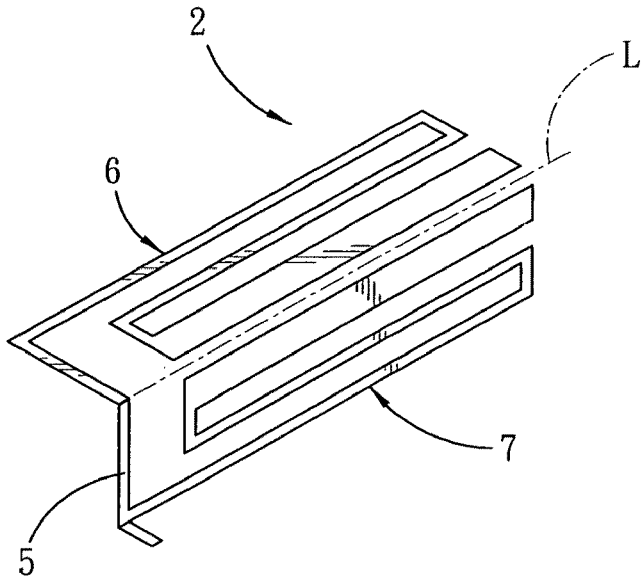
FIG. 2 is a perspective view illustrating a state where the first preferred embodiment is bent about an axis of symmetry.

It is noted herein that the antenna 2 of this embodiment may be bent about the axis of symmetry (L) such that the first monopole radiating element 6 extends in a first plane, the second monopole radiating element 7 extends in a second plane transverse to the first plane, and a portion of the feeding element 5 extends in the first and second planes, as best shown in FIG. 2. As such, the physical size of the antenna 2 of this invention is significantly reduced.

Figure 5:
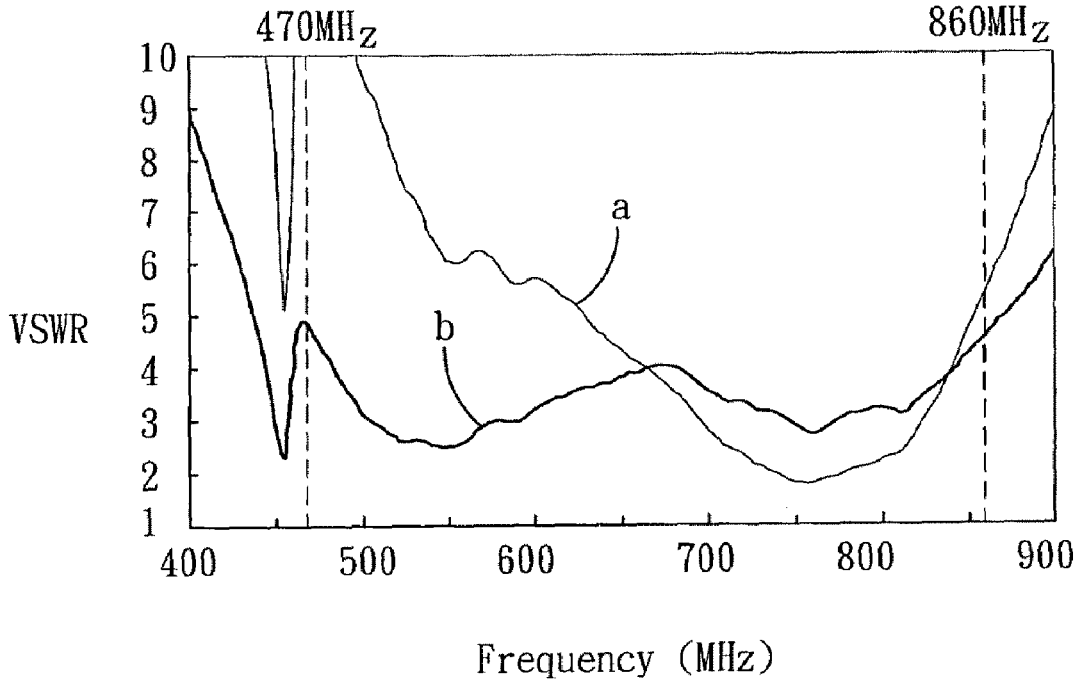
FIG. 5 is a plot illustrating voltage standing wave ratios (VSWRs) of the first and second preferred embodiments.
Figure 6:
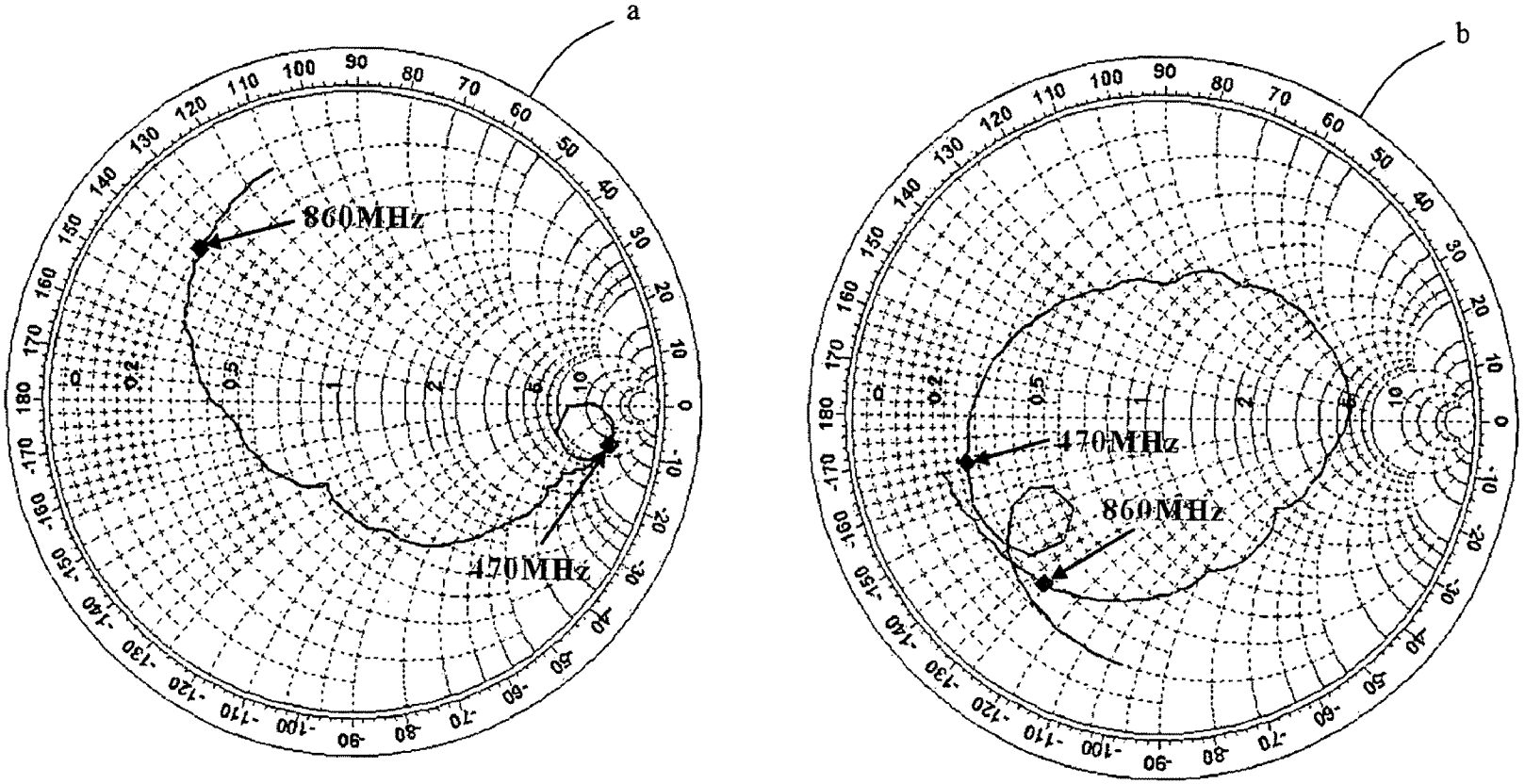
FIG. 6 are Smith charts illustrating responses of the first and second preferred embodiments.
Figure 7:
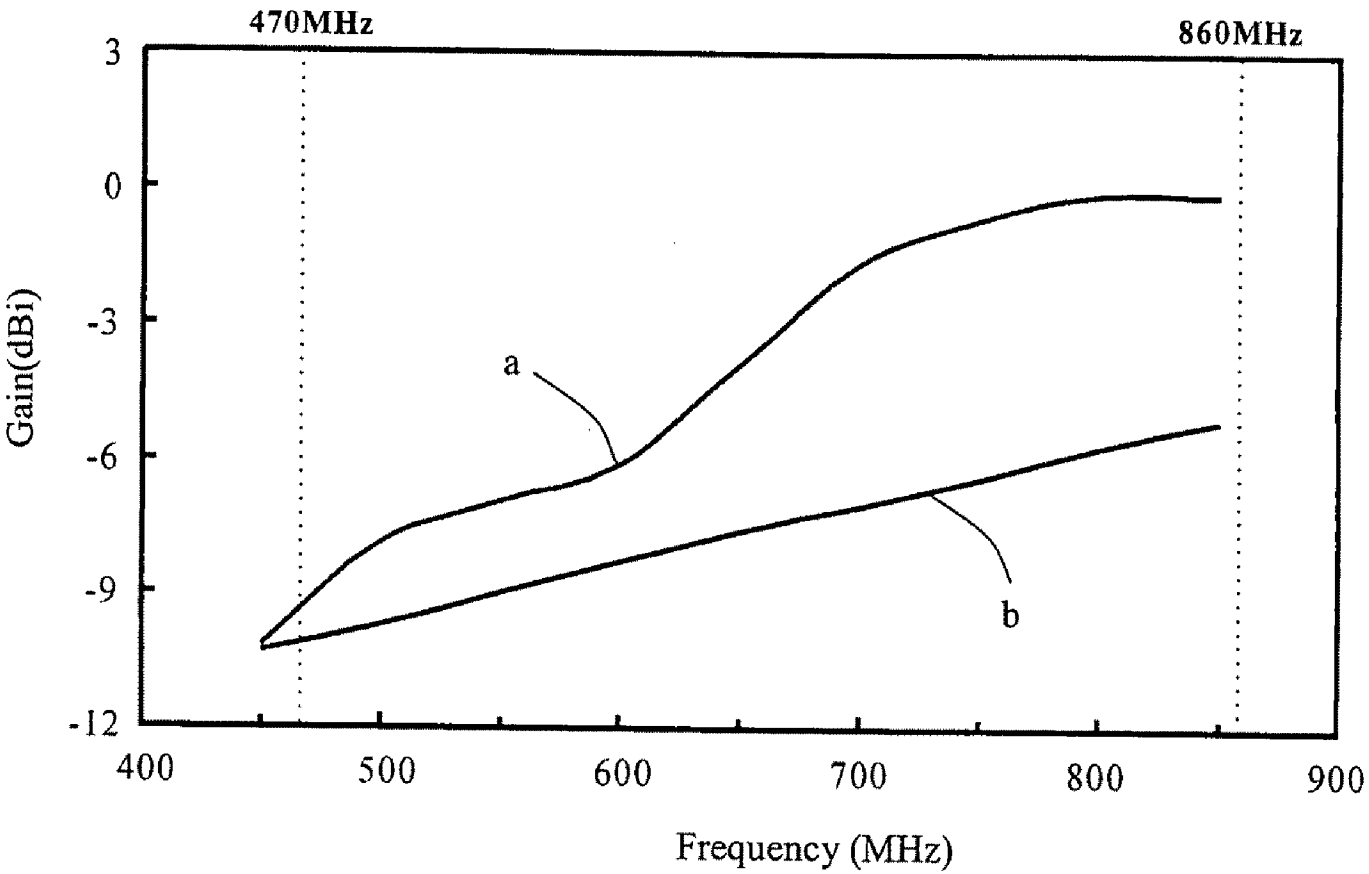
FIG. 7 are plots illustrating gains of the first and second preferred embodiments.

FIG. 5 shows a voltage standing wave ratio (VSWR) of the antenna 2 of this embodiment, as indicated by line (a). Moreover, FIG. 6 shows a response of the antenna 2 of this embodiment, as plotted on Smith chart (a). Further, FIG. 7 shows a gain of the antenna 2 of this embodiment, as indicated by line (a).

Figure 3:
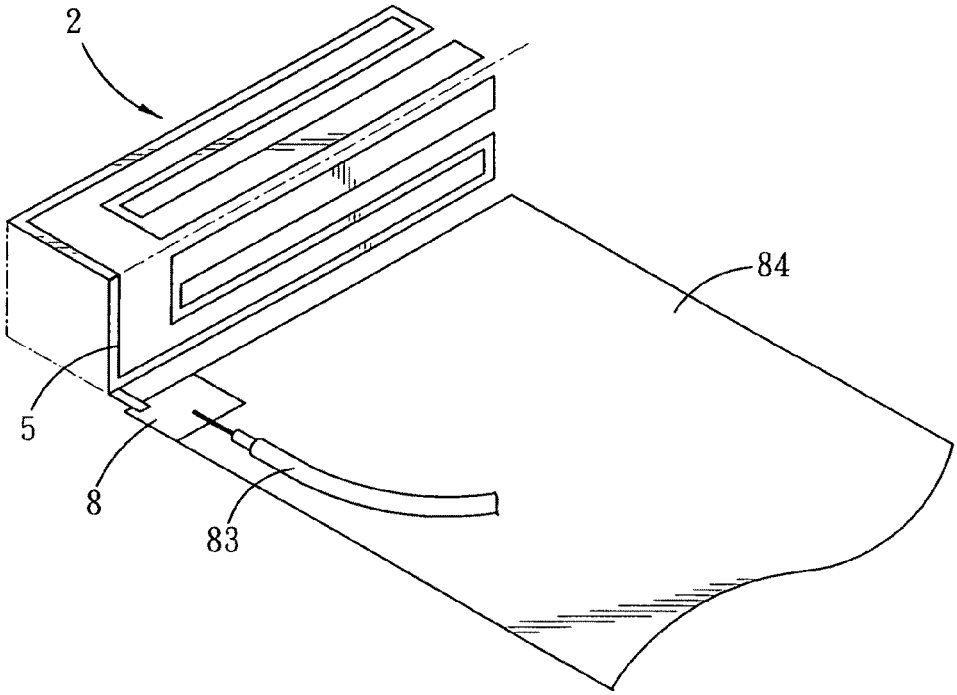
FIG. 3 is a perspective view of the second preferred embodiment of an antenna according to this invention.
Figure 4:
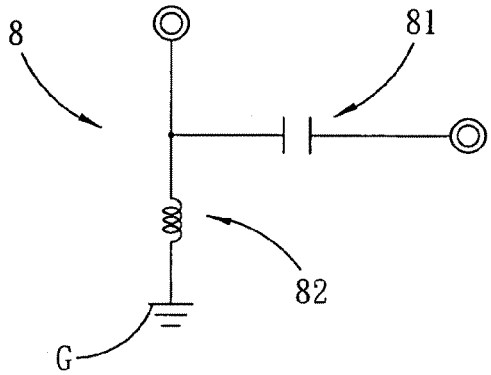
FIG. 4 is a circuit diagram illustrating an impedance matching circuit of the second preferred embodiment.

FIG. 3 illustrates the second preferred embodiment of an antenna 2 according to this invention. When compared to the previous embodiment, the antenna 2 of this embodiment further includes an impedance matching circuit 8 formed on a dielectric substrate 84, such as an FR4 substrate. In this embodiment, with additional reference to FIG. 4, the impedance matching circuit 8 includes a capacitor 81 and an inductor 82. The capacitor 81 has a first capacitor terminal coupled to the feeding element 5, and a second capacitor terminal coupled to a signal line 83. The inductor 82 has a first inductor terminal coupled to the feeding element 5, and a second inductor terminal coupled to an electrical ground (G). Preferably, the capacitor 81 has a capacitance of 4.7 pF and the inductor 82 has an inductance of 15 nH.

Figure 8:
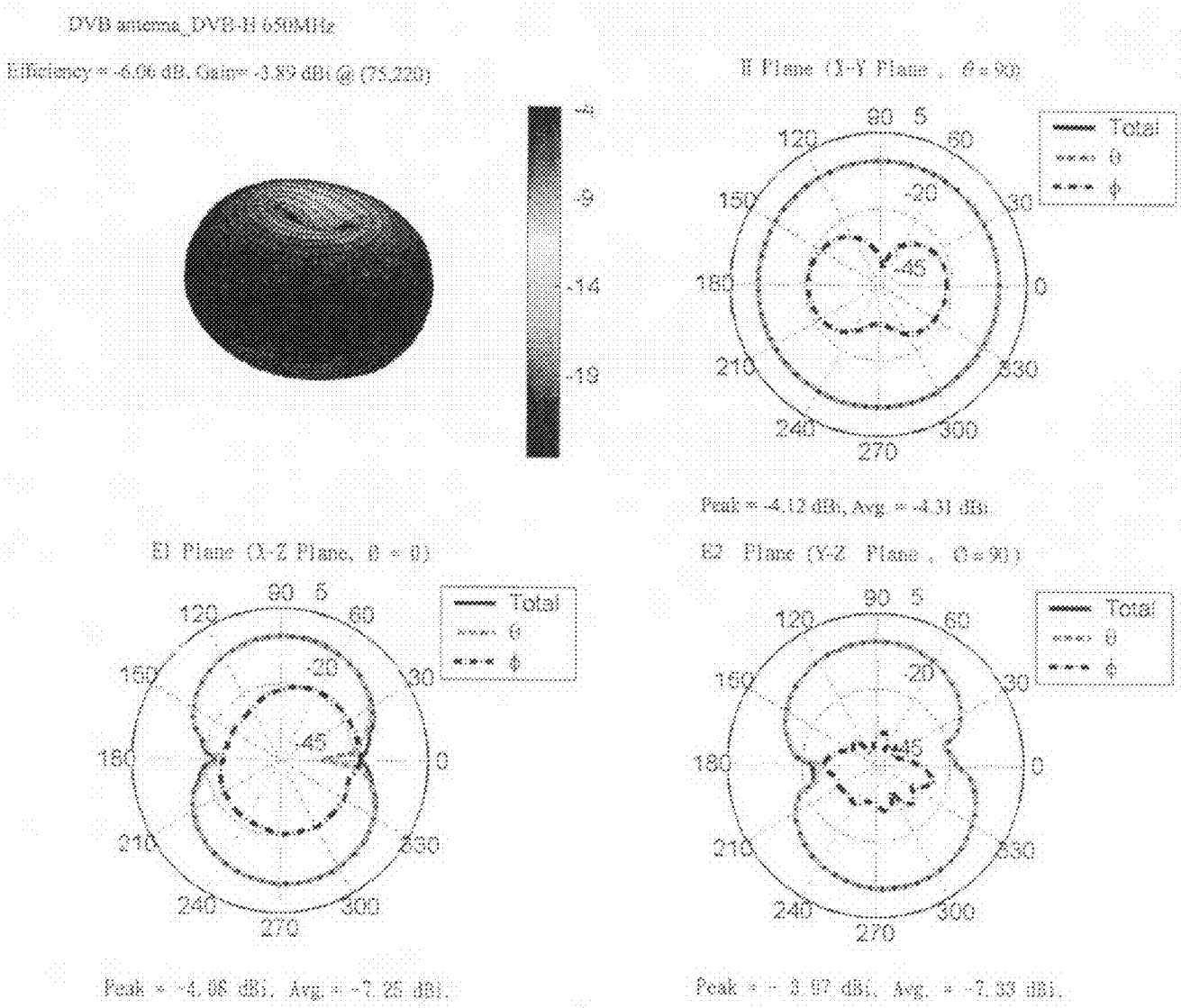
FIG. 8 shows plots of radiation patterns of the second preferred embodiment.

FIG. 5 shows a VSWR of the antenna 2 of this embodiment, as indicated by line (b). Moreover, FIG. 6 shows a response of the antenna 2 of this embodiment, as plotted on Smith chart (b). Further, FIG. 7 shows a gain of the antenna 2 of this embodiment, as indicated by line (b), which complies with the European Information and Communication Technology Association (EICTA) standard. In addition, FIG. 8 illustrates radiation patterns of the antenna 2 of this embodiment on the x-y, the y-z, and the x-z planes when operated at 650 MHz.

It is noted herein that the antenna 2 of this embodiment may be tuned to operate in the DVB-H frequency range by designing each of the first and second monopole radiating elements 6, 7 so as to have a length that is equal to a quarter wavelength at a center frequency of 600 MHz and by adjusting the impedance matching circuit 8.

Figure 9:
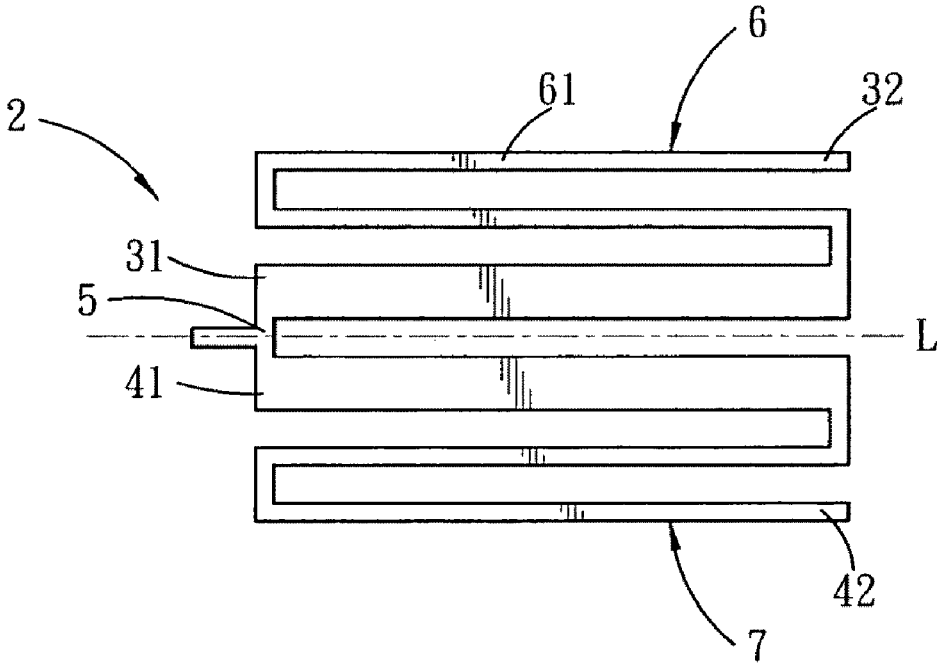
FIG. 9 is a schematic view of the third preferred embodiment of an antenna according to this invention.

FIG. 9 illustrates the third preferred embodiment of an antenna 2 according to this invention. When compared to the previous embodiments, in this embodiment, the first ends 31, 41 of the first and second monopole radiating elements 6, 7 define a distance therebetween smaller than that between the second ends 32, 42 of the first and second monopole radiating elements 6, 7. Moreover, in this embodiment, the feeding element 5 is T-shaped and is symmetrical about the axis of symmetry (L). Further, in this embodiment, the first segment 61 of the first monopole radiating element 6 has a relatively short physical length.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna, comprising:

first and second monopole radiating elements that are symmetrical about an axis of symmetry, each of said first and second monopole radiating elements having a meandering shape, and having opposite first and second ends, wherein said second ends of said first and second monopole radiating elements define a distance therebetween smaller than a distance between said first ends of said first and second monopole radiating elements; and a feeding element interconnecting said first ends of said first and second monopole radiating elements.

2. The antenna as claimed in claim 1, wherein said first ends of said first and second monopole radiating elements are symmetrical about the axis of symmetry.

3. The antenna as claimed in claim 1, wherein said first monopole radiating element further has an intermediate portion that interconnects said first and second ends thereof and that is generally S-shaped.

4. The antenna as claimed in claim 3, wherein said intermediate portion includes first and second segments that are parallel to the axis of symmetry and that are respectively disposed distal from and proximate to the axis of symmetry, a third segment that is parallel to the axis of symmetry and that is disposed between said first and second segments, a fourth segment that is transverse to the axis of symmetry and that interconnects said first and third segments, and a fifth segment that is transverse to the axis of symmetry and that interconnects said second and third segments.

5. The antenna as claimed in claim 4, wherein said second segment and the axis of symmetry define a distance therebetween that is less than 1.5 millimeters.

6. The antenna as claimed in claim 1, further comprising an impedance matching circuit coupled to said feeding element.

7. The antenna as claimed in claim 6, wherein said impedance matching circuit includes a capacitor and an inductor.

8. The antenna as claimed in claim 1, wherein said first monopole radiating element extends along a first plane, said second monopole radiating element extends along a second plane transverse to the first plane, and a portion of said feeding element extends along the first and second planes.

9. An antenna, comprising:

first and second monopole radiating elements that are symmetrical about an axis of symmetry, each of said first and second monopole radiating elements having a meandering shape, and having opposite first and second ends, wherein said first ends of said first and second monopole radiating elements define a distance therebetween smaller than a distance between said second ends of said first and second monopole radiating elements, and said first monopole radiating element has an intermediate portion that interconnects said first and second ends thereof and that is generally S-shaped; and a feeding element interconnecting said first ends of said first and second monopole radiating elements.

10. The antenna as claimed claim 9, wherein said intermediate portion includes first and second segments that are parallel to the axis of symmetry and that are respectively disposed distal from and proximate to the axis of symmetry, a third segment that is parallel to the axis of symmetry and that is disposed between said first and second segments, a fourth segment that is transverse to the axis of symmetry and that interconnects said first and third segments, and a fifth segment that is transverse to the axis of symmetry and that interconnects said second and third segments.

* * * * *